US011353020B2

(12) United States Patent
Jäggle et al.

(10) Patent No.: US 11,353,020 B2
(45) Date of Patent: Jun. 7, 2022

(54) ROTARY PUMP WITH SUPPORTING POCKETS

(71) Applicant: Schwäbische Hüttenwerke Automotive GmbH, Aalen-Wasseralfingen (DE)

(72) Inventors: Gerd Jäggle, Ertingen (DE); Moritz Raatschen, Bad Schussenried (DE); Michael Ehringer, Bad Schussenried (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 98 days.

(21) Appl. No.: 16/291,486

(22) Filed: Mar. 4, 2019

(65) Prior Publication Data

US 2019/0277171 A1 Sep. 12, 2019

(30) Foreign Application Priority Data

Mar. 6, 2018 (DE) ..... 102018105121.2

(51) Int. Cl.

| | |
|---|---|
| ***F04C 2/10*** | (2006.01) |
| ***F04C 14/06*** | (2006.01) |
| ***F04C 2/08*** | (2006.01) |
| ***F04C 15/00*** | (2006.01) |

(52) U.S. Cl.

CPC ..... *F04C 2/102* (2013.01); *F04C 2/084* (2013.01); *F04C 2/086* (2013.01); *F04C 14/06* (2013.01);

(Continued)

(58) Field of Classification Search

CPC ..... F01M 1/02; F01M 2001/0238; F04C 15/0088; F04C 14/06; F04C 2/084;

(Continued)

(56) References Cited

U.S. PATENT DOCUMENTS 3,680,989 A * 8/1972 Brundage ..... F04C 2/102 418/71

4,905,535 A 3/1990 Ludwig et al.

(Continued)

FOREIGN PATENT DOCUMENTS

CN 102678541 A 9/2012
CN 102966535 A 3/2013

(Continued)

OTHER PUBLICATIONS

Extended European Search Report issued in European Patent Application No. 19 16 1045.0, dated Jul. 29, 2019, with partial translation, 10 pages.

(Continued)

*Primary Examiner* — Nathan C Zollinger

(74) *Attorney, Agent, or Firm* — RatnerPrestia

(57) ABSTRACT

A rotary pump, including: a housing featuring a delivery space which includes an inlet for a fluid on a suction side of the rotary pump and an outlet for the fluid on a pressure side of the rotary pump; an inner rotor which is arranged in the delivery space; an outer rotor which is arranged in the delivery space and forms delivery cells with the inner rotor, wherein an outer circumferential wall of the outer rotor is mounted in a sliding manner on an inner circumferential wall of the delivery space, wherein the inner circumferential wall of the delivery space and/or the outer circumferential wall of the outer rotor comprises at least one pocket.

8 Claims, 6 Drawing Sheets

(52) U.S. Cl.
CPC ..... *F04C 15/0088* (2013.01); *F04C 2240/30* (2013.01); *F04C 2240/54* (2013.01)

(58) Field of Classification Search
CPC .. F04C 2/102; F04C 2240/54; F04C 2240/30; F04C 15/00
See application file for complete search history.

(56) References Cited

U.S. PATENT DOCUMENTS

| | | | | | |
|---|---|---|---|---|---|
| 5,501,585 | A * | 3/1996 | Ogawa | F04C 2/102 418/71 |
| 5,711,660 | A * | 1/1998 | Mitarai | F04C 2/102 418/79 |
| 10,578,101 | B2 * | 3/2020 | Ehringer | F04C 2/30 |
| 2016/0281711 | A1 | 9/2016 | Moetakef | |
| 2017/0122311 | A1 | 5/2017 | Moetakef | |
| 2017/0122316 | A1 | 5/2017 | Moetakef | |

FOREIGN PATENT DOCUMENTS

| | | | | |
|---|---|---|---|---|
| DE | 102007055911 | A1 | 7/2008 | |
| DE | 102008053318 | A * | 4/2010 | |
| DE | 102008053318 | A1 | 4/2010 | |
| DE | 102010008062 | B3 | 6/2011 | |
| DE | 102011100105 | A1 | 10/2012 | |
| DE | 102016105258 | A1 | 9/2016 | |
| DE | 102016120500 | A1 | 5/2017 | |
| DE | 102016120502 | A1 | 5/2017 | |
| DE | 102016124117 | A1 | 6/2018 | |
| JP | 0419375 | A | 1/1992 | |
| JP | 04019375 | A * | 1/1992 | F04C 2/084 |
| JP | 07145785 | A | 6/1995 | |
| JP | 2000303966 | A | 10/2000 | |
| JP | 2007263019 | A | 10/2007 | |
| JP | 2014173587 | A * | 9/2014 | |
| JP | 2015045300 | A | 3/2015 | |
| JP | 2015108306 | A | 6/2015 | |

OTHER PUBLICATIONS

German Search Report issued in German Patent Application No. 10 2018 105 121.2 dated Nov. 16, 2018, 8 pages.
Chinese Office Action for Chinese Application No. 201910168776.7, dated Mar. 17, 2020, with translation, 16 pages.

* cited by examiner

ROTARY PUMP WITH SUPPORTING POCKETS

CROSS REFERENCE TO RELATED APPLICATIONS

This application claims priority to German Patent Application No. 10 2018 105 121.2, filed Mar. 6, 2018, the contents of such application being incorporated by reference herein.

FIELD OF THE INVENTION

The invention relates to a rotary pump featuring a housing which comprises a delivery space featuring an inlet for a fluid on a suction side of the rotary pump and an outlet for the fluid on a pressure side of the pump. An outer rotor, which is mounted centrically in the delivery space, and an inner rotor, which is mounted eccentrically in the delivery space, together form delivery cells in order to deliver the fluid from the suction side to the pressure side. The outer rotor comprises an outer circumferential wall which is mounted in a sliding manner on an inner circumferential wall of the delivery space which is in particular formed by the housing.

BACKGROUND OF THE INVENTION

Rotary pumps featuring outer rotors which are mounted in a sliding manner on an inner circumferential wall of a delivery space can have start-up problems, in particular following longer downtimes when the outer circumferential surface of the outer rotor abuts the inner circumferential wall of the delivery space of the rotary pump substantially full-face. The adhesion and/or friction forces between the outer circumferential surface of the outer rotor and the inner circumferential surface can be large enough that when the pump is started up, no fluid or only very little fluid is initially delivered. This can cause damage to the pump and/or to assemblies which are to be supplied with the fluid delivered by the pump, up to and including their destruction.

SUMMARY OF THE INVENTION

An aspect of the invention is a rotary pump which has fewer or no start-up problems, for example during a cold start.

One aspect of the invention relates to a rotary pump which comprises a housing featuring a delivery space which comprises an inlet for a fluid on a suction side of the rotary pump and an outlet for the fluid on a pressure side of the rotary pump. The rotary pump also comprises an inner rotor, which is arranged eccentrically in the delivery space, and an outer rotor which is arranged centrically in the delivery space and forms delivery cells with the inner rotor, wherein an outer circumferential wall of the outer rotor is mounted in a sliding manner on an inner circumferential wall of the delivery space and is preferably guided by said inner circumferential wall. The inner circumferential wall of the delivery space and/or the outer circumferential wall of the outer rotor comprise(s) at least one pocket or, respectively, supporting pocket.

In the region of the pocket, the outer circumferential wall of the outer rotor has no contact with the inner circumferential wall of the delivery space of the rotary pump, i.e. in the region of the pocket, the outer circumferential wall of the outer rotor and the inner circumferential wall of the delivery space do not abut each other in a seal, nor is the outer rotor guided by the inner circumferential wall, in particular by the housing. The rotary pump can in particular be an internally toothed wheel pump or a pendulum-slider pump. The rotary pump is preferably embodied as a lubricating oil pump of a motor vehicle, in particular for lubricating and/or cooling an internal combustion engine of the motor vehicle.

The pocket can be arranged on the outer rotor or on the inner circumferential wall of the delivery space, in particular the inner circumferential wall of the housing, or exhibit a radial and axial extent dimensioned such that there is no direct connection between the pocket and the outlet. A direct connection, such as for example a channel or groove which connects the pocket to the outlet, is preferably absent. The terms "axial" and "radial" refer in particular to the rotary axis of the inner rotor and/or outer rotor, such that the expression "axial" denotes in particular a direction extending parallel to or coaxial with the rotary axis. Furthermore, the expression "radial" denotes in particular a direction extending perpendicular to the rotary axis. A "radial extent" is in particular intended to mean an extent along or parallel to a radial direction. An "axial extent" is in particular intended to mean an extent along or parallel to an axial direction.

The pocket is preferably supplied with the fluid from the delivery space only by leakage. In order to set the supply of the fluid from the delivery space to the pocket, sealing gaps—for example, an axial sealing gap between an end-facing side of the outer rotor and an axial wall of the housing—and/or the dimensions of the pocket, for example the axial and/or radial extent of the pocket, can be correspondingly selected. The sealing gaps and/or the pocket are advantageously embodied in such a way that the smallest leakage possible occurs between the delivery space and the pocket. It is in principle conceivable to divert a fluid outside the delivery space in order to supply the pocket, wherein the fluid can be the fluid delivered by the rotary pump or a fluid provided in some other way. A filtered and/or cooled fluid can then be used to supply the pocket, which can reduce wear.

The pocket can extend in the axial direction of the delivery space and outer rotor over the entire axial length of the outer rotor, featuring open axial end-facing sides; alternatively, it can extend over only some of the axial length of the outer rotor, featuring only one open end-facing side or two closed end-facing sides. The pocket can be shorter in the axial direction than the axial length of the outer rotor and can be arranged centrally relative to it.

Preferably, the radial extent of the pocket is substantially smaller than the axial extent of the pocket. The radial extent advantageously measures 20% at most of the axial extent, particularly advantageously 10% at most of the axial extent, and most particularly advantageously 5% at most of the axial extent. The radial extent of the pocket advantageously measures 3 millimeters at most, particularly advantageously 1.5 millimeters at most, and most particularly advantageously 0.5 millimeters at most.

The pocket can preferably be supplied or filled with the fluid delivered by the rotary pump, for example by leakage within the delivery space. It is in principle also conceivable to supply or fill the pocket via separate feed conduits, such as for example passage channels through the outer rotor or through the wall of the delivery space which emerge in the pocket.

The rotary pump can also comprise at least one connection which fluidically connects the pocket to the outlet from the delivery space or the pressure side of the rotary pump and/or to the inlet into the delivery space or the suction side of the rotary pump. The rotary pump can comprise a pocket which is connected to the inlet via a connection such as for example a channel or a groove. Additionally or alternatively, the rotary pump can comprise a pocket which is connected to the outlet via a connection such as for example a channel or a groove. The connection can for example be a groove or channel in an inner side of a cover or base, wherein said inner side faces the delivery space, wherein the cover and base axially delineate the delivery space which emerges into the inlet and/or outlet and extends up to or at least nearly up to the inner circumferential wall of the delivery space. Additionally or alternatively, the rotary pump can comprise a groove or channel in the inner circumferential wall of the delivery space and/or in the outer circumferential wall of the outer rotor. The groove or channel in the inner circumferential wall of the delivery space can be connected to a groove or channel in the cover or base which axially delineate the delivery space. The groove or channel in the inner circumferential wall of the delivery space can also connect a pocket, which does not extend axially as far as the base or cover and therefore exhibits one closed end-facing side, to the base or cover. The groove or channel can connect the inlet and/or outlet to the pocket by the shortest route or can be curved.

The rotary pump can comprise a pocket which is fluidically connected, via a connection such as for example a channel or groove, to at least one of the delivery cells, wherein this connection can extend into the driving stay, in particular into a region of maximum toothed engagement between the rotors, or into the sealing stay, in particular into a region of minimum or zero toothed engagement between the rotors, for example as a channel/groove which is open towards the delivery space in an upper side of the cover and/or base which faces the delivery space. The driving stay and the sealing stay are each arranged between the inlet and the inlet as viewed along a rotational direction.

Alternatively, the connection which supplies or fills the pocket with the fluid via the inlet, the outlet, the driving stay or the sealing stay can extend outside the delivery space.

The pocket can be arranged in the region of the outlet from the delivery space, in the region of the inlet into the delivery space, in the region of the sealing stay or in the region of the driving stay. The pocket can be arranged adjacent to the outlet, adjacent to the inlet, adjacent to the sealing stay or adjacent to the driving stay as viewed in the radial direction.

The pocket can extend from the outlet up to the inlet in the circumferential direction of the outer circumferential wall and/or inner circumferential wall. The pocket can emerge into the inlet and/or outlet and thus for example permanently connect the inlet into the delivery space to the outlet from the delivery space. In one embodiment, the pocket can extend around the entire circumference of the outer rotor.

The pocket can extend from the sealing stay up to the driving stay in the circumferential direction of the outer circumferential wall of the outer rotor and the inner circumferential wall of the delivery space.

The pocket which extends in the circumferential direction can simultaneously be connected to the inlet and/or the outlet and/or at least one of the delivery cells in the region of the sealing stay and/or the driving stay, i.e. the pocket which extends in the circumferential direction can for example comprise a combined connection to the inlet and/or the outlet and/or at least one of the delivery cells on the sealing stay and/or driving stay.

If the rotary pump comprises more than one pocket, for example two, three or more pockets, a first pocket can lie in the region of the inlet into the delivery space, and a second pocket can lie in the region of the outlet from the delivery space. The first pocket and the second pocket can for example be arranged opposite each other in relation to a rotary axis of the outer rotor or can be arranged offset with respect to each other in the circumferential direction, in or counter to a rotational direction of the pump.

If more than one pocket is provided, the plurality of pockets can be arranged in a distribution, preferably a uniform distribution, over the inner circumference of the delivery space and/or the outer circumference of the outer rotor.

If the inner circumferential wall of the delivery space and/or the outer circumferential wall of the outer rotor comprises at least two pockets, these pockets can be fluidically connected to each other via a connection. Said connection can be formed in the inner circumferential wall of the delivery space and/or the outer circumferential wall of the outer rotor. The connection can connect the pockets to each other permanently or in accordance with the rotational position of the outer rotor. If more than one pocket is provided, at least one of the pockets can differ from at least one of the other pockets in terms of for example its geometry and/or shape and/or size.

The inner rotor or the outer rotor can be connected or coupled to a drive, such as for example an electric motor or a shaft driven by an internal combustion engine, wherein said drive generates the drive energy for the rotary pump. The rotor is preferably connected to an electric motor. If the motor vehicle comprises an internal combustion engine as its drive, then the rotary pump can be driven by the electric motor, preferably independently of the internal combustion engine, for example when the internal combustion engine is at a stop. Advantageously, the rotary pump comprises the electric motor. The rotary pump is preferably embodied as an electric rotary pump. The rotary pump is preferably embodied as an auxiliary pump and/or additional pump for supporting and/or at least partially replacing a main or primary pump in a lubricant and/or coolant system of a motor vehicle. Being "embodied" is in particular intended specifically to mean being provided, configured, implemented, arranged and/or programmed.

A rotational direction of the rotary pump can preferably be switched, such that the pump can be employed flexibly. Switching the rotational direction of the rotary pump changes the delivery flow direction, through the rotary pump, of the medium to be delivered; in other words, the pump is a reversible rotary pump.

A second aspect relates to a cup-shaped part of a housing for a rotary pump, in particular for an internally toothed wheel pump or a pendulum-slider pump, which forms an inner circumferential wall and a base of a delivery space of the rotary pump. The inner circumferential wall comprises at least one pocket such as has been described in relation to the first aspect of the invention. The inner circumferential wall can also comprise a connection such as has been described in relation to the first aspect of the invention. Instead of the cup-shaped part of the housing together with the base, the housing part can also form the inner circumferential wall of the delivery space only.

A third aspect of the invention relates to an outer rotor, for example for an internally toothed wheel pump. An outer circumferential wall of the outer rotor comprises at least one pocket such as has been described in relation to the first aspect of the invention. The outer circumferential wall can also comprise a connection such as has been described in relation to the first aspect of the invention.

The housing part according to the second aspect and/or the outer rotor according to the third aspect can be stored separately and can for example replace the corresponding housing part and/or the outer rotor of a conventional rotary pump.

The following aspects form part of the scope of the description. Individual features in the aspects can be adduced in order to advantageously develop the rotary pump.

Aspect 1. A rotary pump, comprising:

a housing featuring a delivery space featuring an inlet for a fluid on a suction side of the rotary pump and an outlet for the fluid on a pressure side of the rotary pump;

an inner rotor which is arranged eccentrically in the delivery space and preferably connected to a drive via a drive shaft;

an outer rotor which is mounted centrically in the delivery space and onto which the inner rotor outputs, wherein a radius of an outer circumferential wall of the outer rotor substantially corresponds to a radius of an inner circumferential wall of the delivery space;

characterized in that at least one pocket which extends radially outwards is embodied in the inner circumferential wall of the delivery space and/or at least one pocket which extends radially inwards is embodied in the outer circumferential wall of the outer rotor.

Aspect 2. The rotary pump according to Aspect 1, wherein the pocket/s extend(s) in the axial direction over at least some of a axial length of the delivery space and/or outer rotor.

Aspect 3. The rotary pump according to any one of the preceding aspects, wherein the pocket/s is/are arranged centrally in the axial direction in the inner circumferential wall of the delivery space and/or in the outer circumferential wall of the outer rotor, or is/are at least open on an end-facing side which faces a base and/or cover which axially delineate the delivery space.

Aspect 4. The rotary pump according to any one of the preceding aspects, wherein the at least one pocket is separated from the inlet and/or outlet for the fluid.

Aspect 5. The rotary pump according to any one of the preceding aspects, wherein the at least one pocket is connected to the suction side and/or the pressure side of the pump.

Aspect 6. The rotary pump according to any one of the preceding aspects, wherein the at least one pocket is embodied in the region of the sealing stay and/or the driving stay.

Aspect 7. The rotary pump according to any one of the preceding aspects, wherein at least one pocket is embodied in the region of the inlet for the fluid into the delivery space, and at least one pocket is embodied in the region of the outlet for the fluid from the delivery space, respectively.

Aspect 8. The rotary pump according to any one of the preceding aspects, wherein if more than one pocket is provided, the plurality of pockets are arranged in a uniform distribution over the inner circumference of the delivery space and/or the outer circumference of the outer rotor.

Aspect 9. The rotary pump according to any one of the preceding aspects, wherein if more than one pocket is provided, at least one of the pockets exhibits a geometry, shape or size which is for example different to at least one of the other pockets.

Aspect 10. The rotary pump according to any one of the preceding aspects, wherein the drive is an electric motor.

BRIEF DESCRIPTION OF THE DRAWINGS

In the following, aspect of the invention are described in more detail on the basis of figures. Features essential to aspects of the invention which can only be gathered from the figures form part of the scope of aspects of the invention and can advantageously develop the rotary pump in accordance with claim 1, alone or in combinations shown.

The individual figures show.

DETAILED DESCRIPTION OF THE INVENTION

Figure 1:
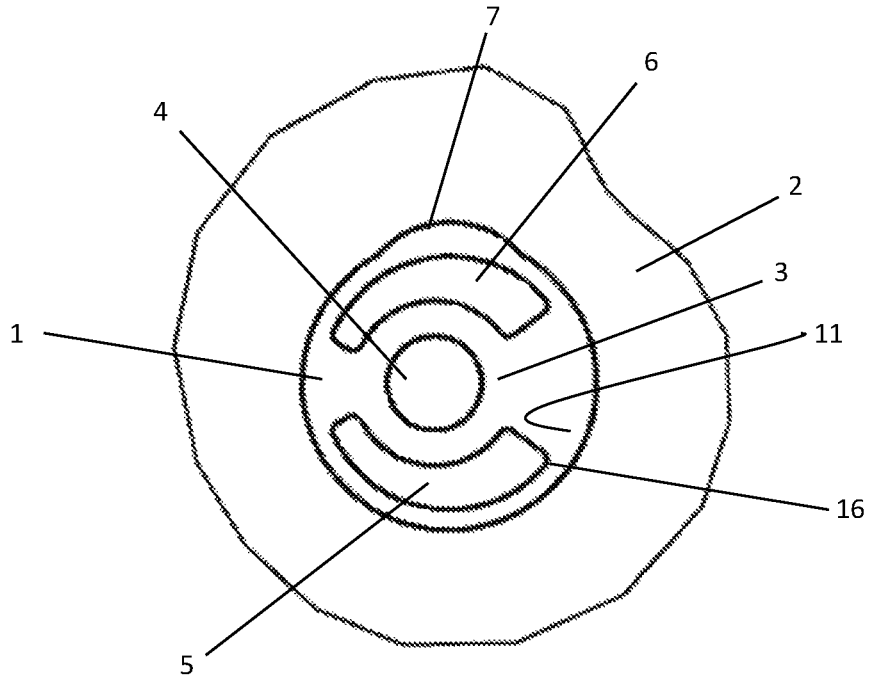
FIG. 1 a delivery space featuring a pocket in the inner circumferential wall of the delivery space in a central region of the outlet from the delivery space.

FIG. 1 shows a view from above into a delivery space 1 of a rotary pump. Of the rotary pump, a part of the housing 2 can be seen, together with the base 3 of the delivery space 1. An opening 4 is formed eccentrically in the base 3, through which a drive axle for the inner rotor 9, shown only in FIGS. 3, 7, 9 and 10, can for example be guided into the interior of the delivery space 1.

An inlet 5 for a fluid into the delivery space 1, and an outlet 6 for the fluid from the delivery space 1, are also formed in the base 3. The numbering applies to a rotary pump featuring an inner rotor 9 which rotates anti-clockwise. If the rotational direction is reversed, the inlet 5 correspondingly comes to form the outlet 6, and the outlet 6 becomes the inlet 5.

The housing 2 forms an inner circumferential surface 11 of the delivery space 1 which, together with an outer circumferential surface 12 of the outer rotor 10 which is likewise shown only in FIGS. 3, 7, 9 and 10, forms a sealing gap 16 over large parts of the circumference, such that the inner circumferential surface 11 forms a guide or sliding surface for the outer rotor 10.

A pocket 7, which extends radially outwards, is formed in the inner circumferential surface 11 in the region of the outlet 6. The pocket 7 is arranged centrally with respect to the outlet 6 as viewed in the circumferential direction. The outer circumferential surface 12 of the outer rotor 10 and the inner circumferential surface 11 of the delivery space 1 are clearly spaced from each other in the region of the pocket 7, such that the outer rotor 10 is not guided by the inner circumferential surface 11 in the region of the pocket 7. Fluid can pass into the pocket 7, for example via a leakage flow, from the outlet 6 and/or from at least one delivery cell 13 which is formed by the inner rotor 9 and outer rotor 10 and in which the fluid is transported from the inlet 5 to the outlet 6 and can be compressed and/or raised to a higher pressure level in the process.

The fluid can for example be an oil which is pumped from a reservoir to a consumer. The fluid or oil which collects in the pocket 7 can then be used, when starting up the rotary pump, to ensure instant lubrication in the sealing gap between the inner circumferential wall 11 and the outer circumferential surface 12 of the outer rotor 10, such that the force necessary in order to start up the rotary pump can be reduced. The fluid accumulated in the pocket 7 can also have a damping effect and contribute to greater operational smoothness in the rotary pump, i.e. for example lower noise emissions, during operation of the rotary pump. Lastly, the fluid in the pocket 7 can prevent or at least delay wear on the outer circumferential surface 12 of the outer rotor 10 and on the inner circumferential surface 11 of the delivery space 1 and thus increase the operational service life of the rotary pump.

Figure 2:
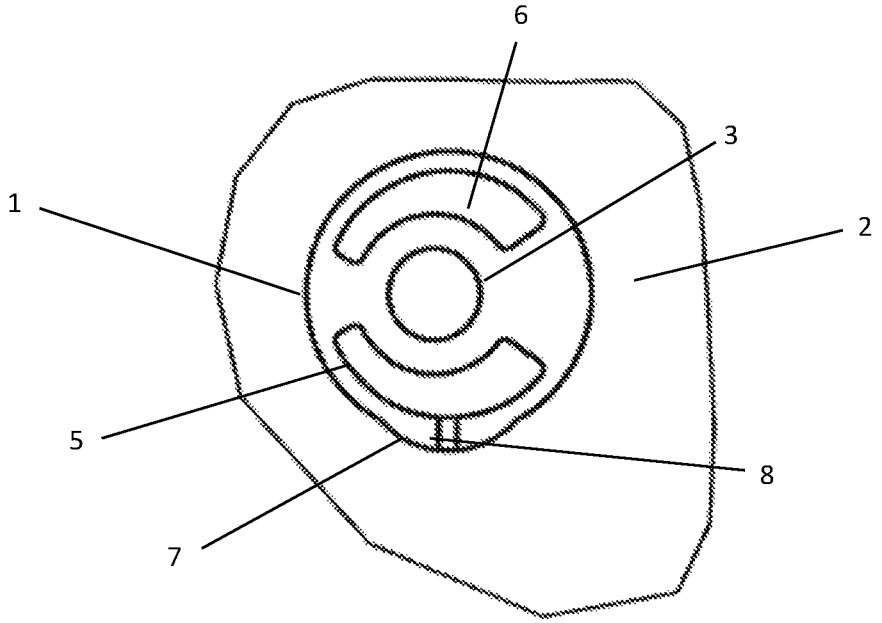
FIG. 2 a delivery space featuring a pocket in the inner circumferential wall of the delivery space in the region of the inlet into the delivery space, and a connecting channel which connects the pocket to the inlet.

In FIG. 2, the pocket 7 is formed in the region of the inlet 5 and connected to the inlet 5 via a connection 8 in the base 3. Fluid can flow from the inlet 5 into the pocket 7 via the connection 8 and fill the pocket 7 with the fluid to be pumped. The connection 8 is embodied as a groove in the base 3, wherein the groove is open towards the delivery space 1.

Figure 3:
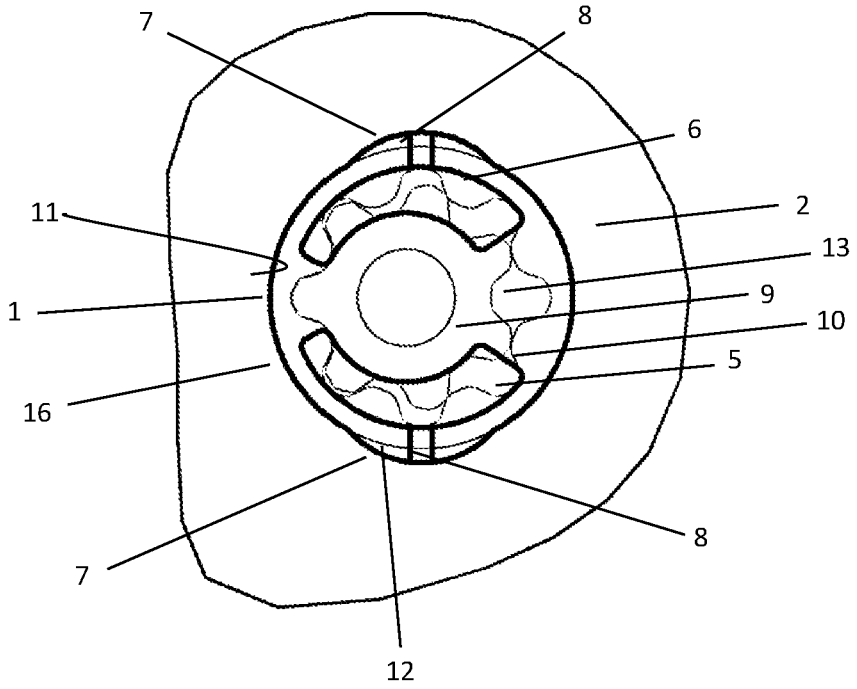
FIG. 3 a delivery space with an inner rotor and outer rotor indicated, each featuring a pocket in the inner circumferential wall of the delivery space in the region of the inlet into the delivery space and in the region of the outlet from the delivery space, and a connecting channel which connects one of the pockets to the inlet, and another connecting channel which connects the other of the pockets to the outlet.

FIG. 3 shows an embodiment of an aspect of the invention in which two pockets 7 are formed in the inner circumferential surface 11 of the delivery space 1. The inner rotor 9 and the outer rotor 10 are indicated in FIG. 3. A pocket 7 is formed in the region of each of the inlet 5 and outlet 6. Each of the pockets 7 is connected to the inlet 5 or, respectively, outlet 6 assigned to it via a connection 8. The two connections 8 shown or the pockets 7 can be fluidically connected to each other by another connection (not shown) which can for example be formed in the inner circumferential wall 11 or in the base 3.

Figure 4:
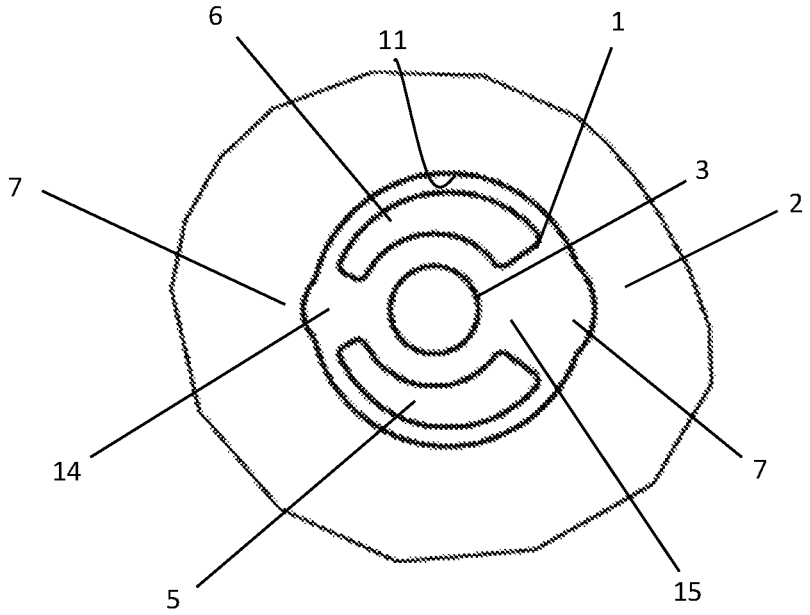
FIG. 4 a delivery space featuring a pocket in the inner circumferential wall of the delivery space in the region of each of the sealing stay and the driving stay.
Figure 5:
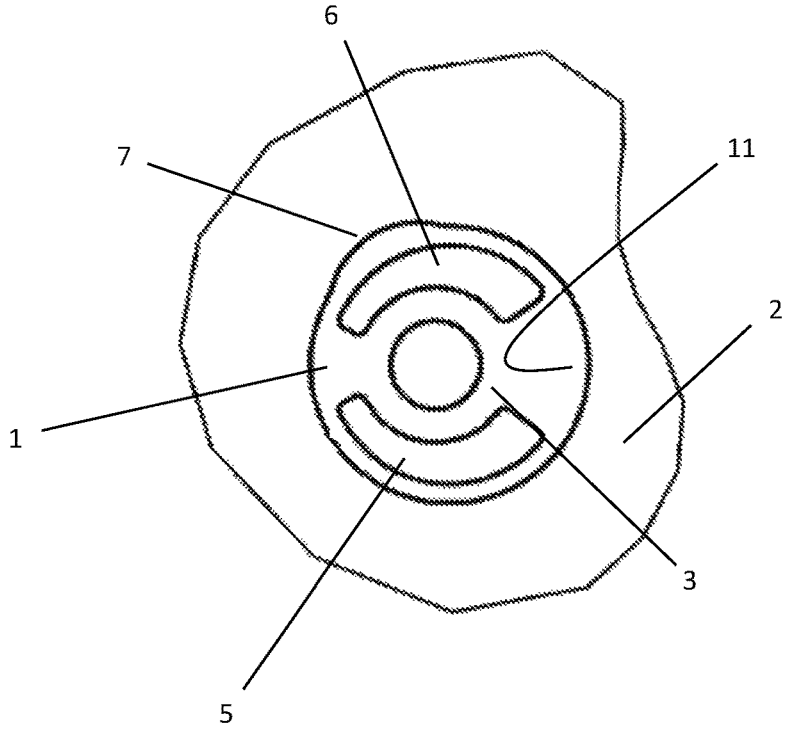
FIG. 5 a delivery space featuring a pocket in the inner circumferential wall of the delivery space in a region of the outlet from the delivery space which is offset in or counter to a rotational direction of the rotary pump.

In FIG. 4, a pocket 7 is embodied in the inner circumferential wall 11 in the region of each of the driving stay 14 and the sealing stay 15. In FIG. 5, which substantially corresponds to FIG. 1, the one pocket 7 is not arranged centrally, but instead offset with respect to the outlet 6, as viewed in the circumferential direction. The pocket 7 of this embodiment can in particular be supplied and filled with fluid from delivery cells 13, shown only in FIGS. 3, 7, 9 and 10, passing over it and/or by a leakage flow.

Figure 6:
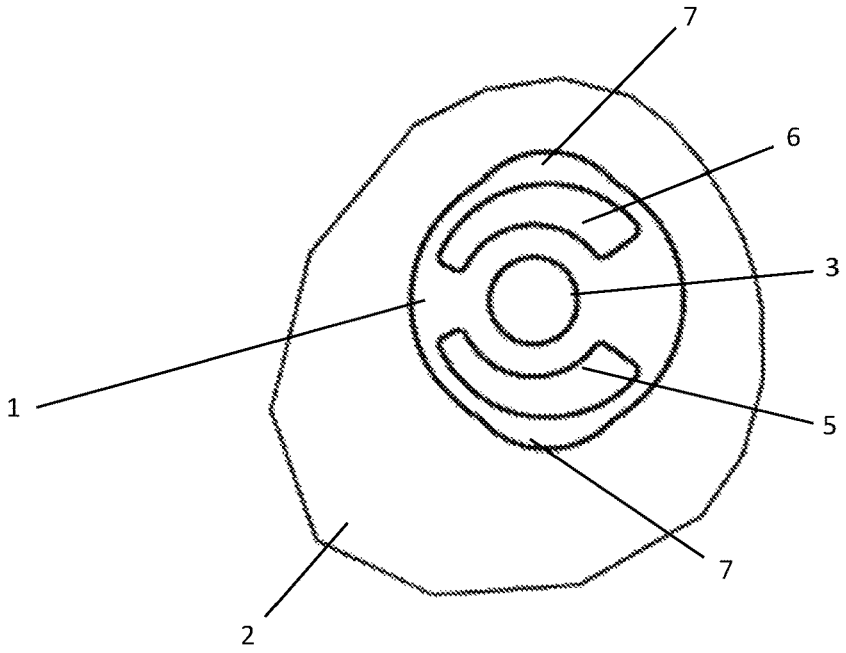
FIG. 6 a delivery space featuring a pocket in the inner circumferential wall of the delivery space in the region of each of the inlet into the delivery space and the outlet from the delivery space.

In the example embodiment of FIG. 6, the arrangement of the pockets 7 in the inner circumferential surface 11 corresponds to the arrangement as shown in FIG. 3. Unlike in FIG. 3, the pockets 7 are not connected to the inlet 5 or, respectively, the outlet 6 via a connection 8 in each case but are instead supplied with the fluid via a leakage flow and possibly via delivery cells 13 passing over them.

Figure 7:
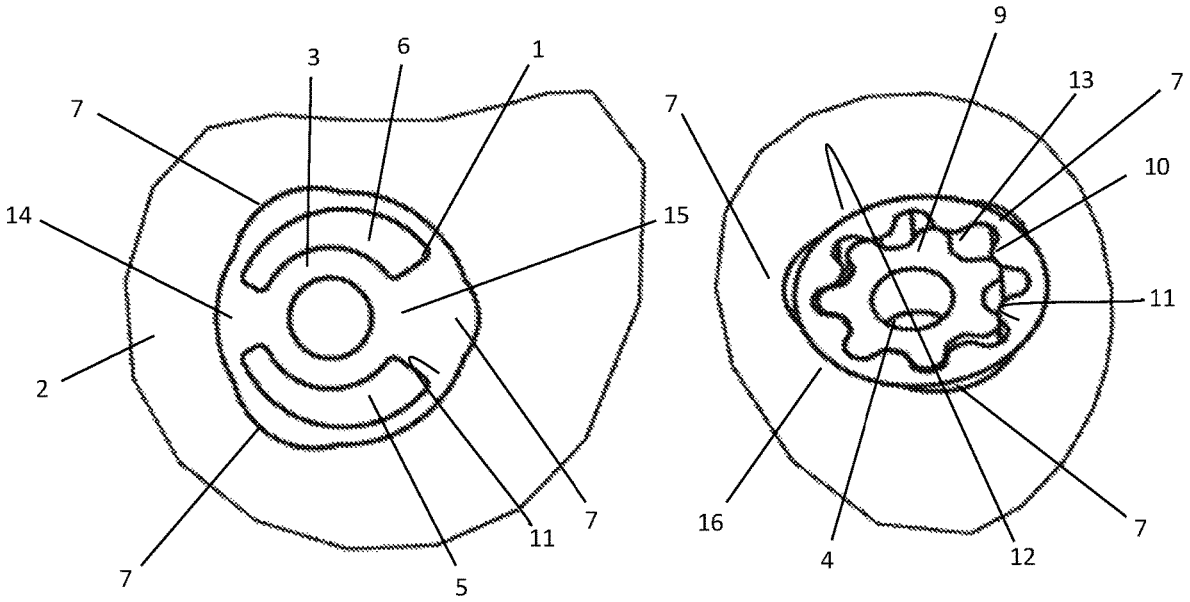
FIG. 7 a delivery space featuring three pockets in the inner circumferential wall of the delivery space, in a plan view and a perspective view featuring the inner rotor and outer rotor.

FIG. 7 shows an example embodiment of a rotary pump in accordance with an aspect of the invention featuring three pockets 7 which are arranged in a substantially uniform distribution over the circumference of the delivery space 1 and therefore as viewed in in the circumferential direction. The pockets 7 can all be embodied identically, or each of the pockets 7 can exhibit a geometry and/or shape and/or size which is different to one of the other pockets 7.

The housing 2 is shown together with the delivery space 1 in a perspective view. The outer rotor 10 is arranged in the delivery space 1, and an eccentrically mounted inner rotor 9 is arranged in the outer rotor 10. The inner rotor 9 and outer rotor 10 together form delivery cells 13 in which the fluid can be transported from the inlet 5 to the outlet 6, wherein the fluid pressure is increased and/or the fluid is compressed while bring transported. The inner rotor 9 or the outer rotor 10 can be connected to a rotary drive, wherein the driven inner rotor 9 or outer rotor 10 transmits the rotational movement onto the non-driven outer rotor 10 or inner rotor 9.

Figure 8:
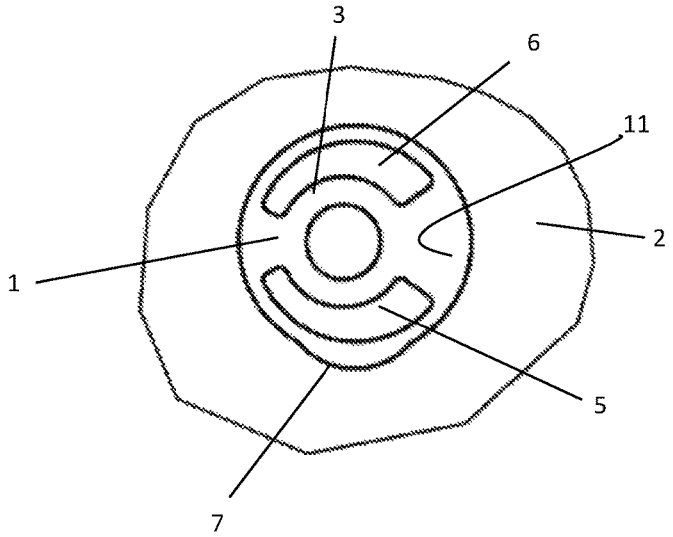
FIG. 8 a delivery space featuring a pocket in the inner circumferential wall of the delivery space in a central region of the inlet into the delivery space.

The example embodiment of FIG. 8 substantially corresponds to that of FIG. 2. In FIG. 8, the pocket 7 is arranged centrally in the region of the inlet 5 as viewed in the circumferential direction. The pocket 7 lacks a direct connection to the inlet 5 and outlet 6. Alternatively, the rotary pump can comprise a connection which connects the pocket 7, which is arranged in the region of the inlet 5, to the outlet 6. The connection can extend in the base 3, the outer circumferential surface 12 and/or the inner circumferential surface 11.

Figure 9:
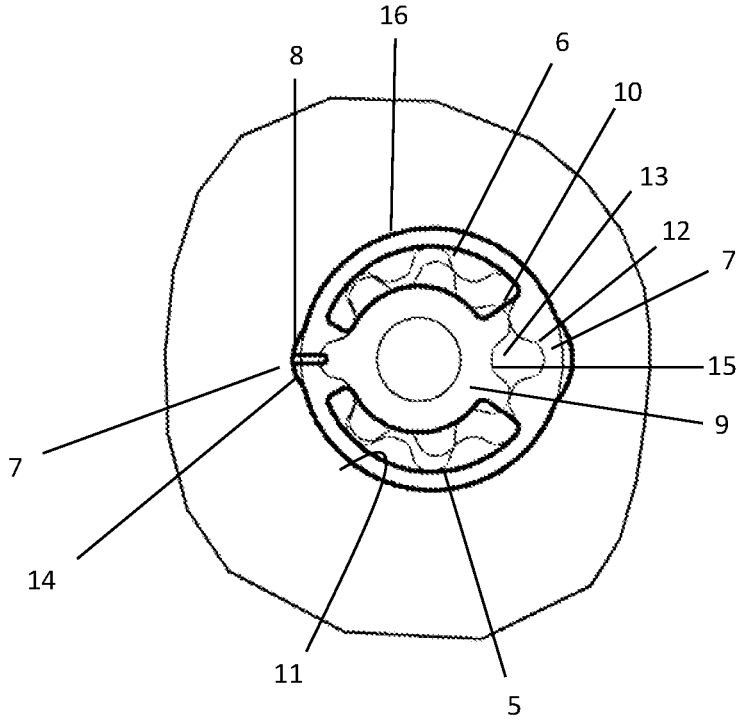
FIG. 9 a delivery space with an inner rotor and outer rotor indicated, each featuring a pocket in the inner circumferential wall of the delivery space in the region of the sealing stay and the driving stay, and a connection in the region of the driving stay which connects the pocket to a delivery cell of the rotary pump.

In FIG. 9, a pocket 7 is arranged in the region of each of the sealing stay 15 and driving stay 14. A connection 8 which is embodied in the driving stay 14 connects the pocket 7 to the delivery cell 13 which is respectively passing over the connection 8, such that the residual fluid from this delivery cell 13, which can be at a particularly high pressure (in particular a squeezing pressure), can flow into the pocket 7. This pressure relief on or in the driving stay 14 can be advantageous for operational smoothness in the inner rotor 9, since forces orthogonal to the rotary axis of the inner rotor 9 can thus be reduced.

Figure 10:
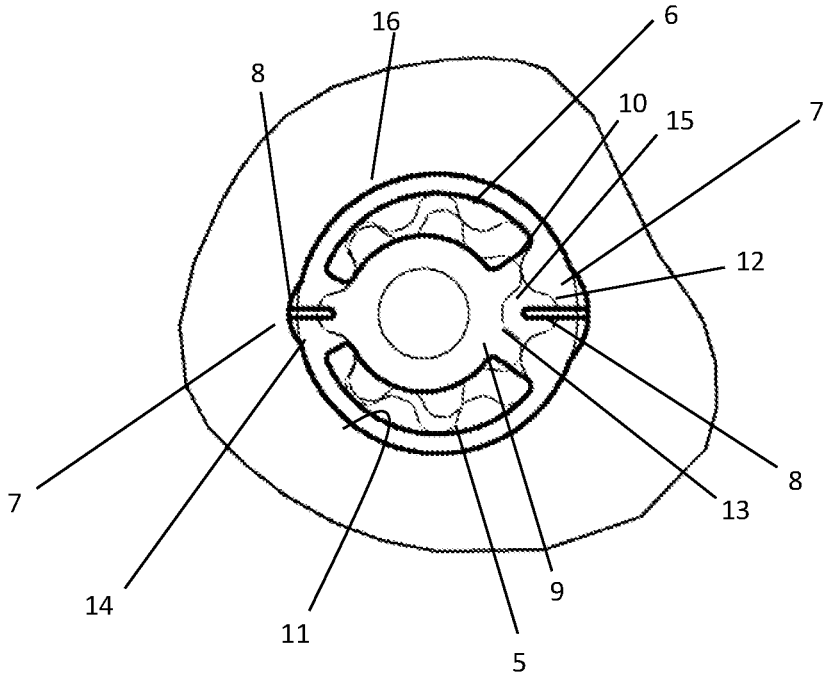
FIG. 10 a delivery space with an inner rotor and outer rotor indicated, each featuring a pocket in the inner circumferential wall of the delivery space in the region of the sealing stay and the driving stay, as well as a connection in the region of the driving stay and a connection in the region of the sealing stay.
Figure 11:
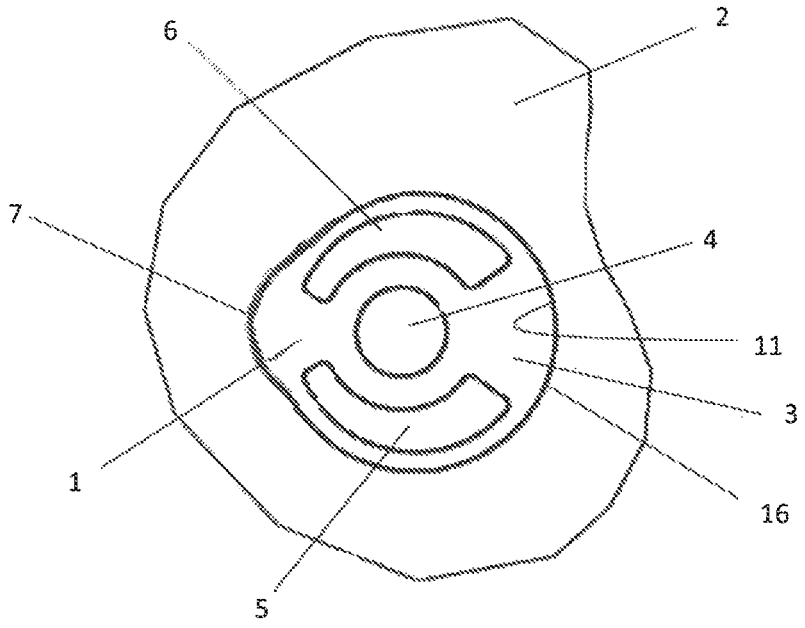
FIG. 11 a delivery space featuring a pocket that extends from an inlet to an outlet.
Figure 12:
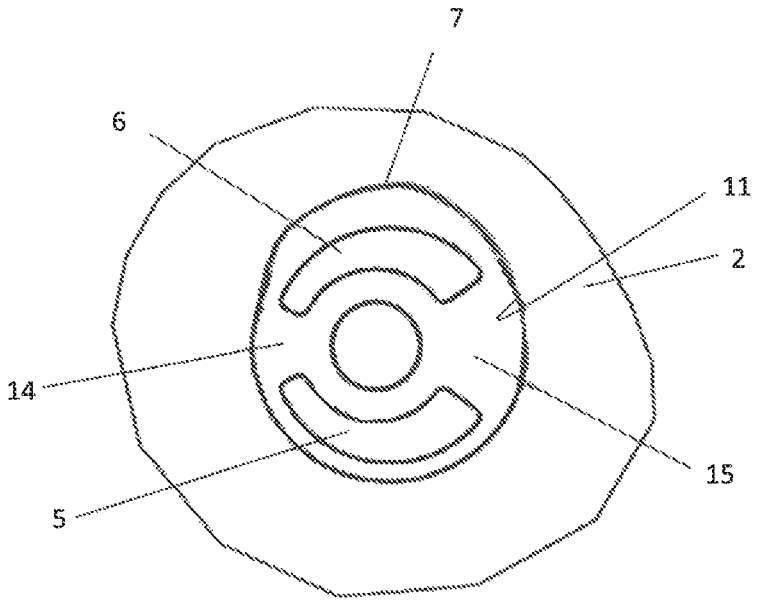
FIG. 12 a delivery space featuring a pocket that extends from a sealing stay to a driving stay.

In FIG. 10, a pocket 7 is arranged in the region of each of the sealing stay 15 and driving stay 14. A connection 8 which is embodied in each of the driving stay 14 and sealing stay

15 connects the respective pocket 7 to the delivery cell 13 which is respectively passing over the connection 8.

The person skilled in the art will recognize from the preceding description that other variations are also disclosed by aspects of the invention, such as for example supplying additional pockets 7, i.e. not only the pockets 7 shown in the figures, via connections 8. The person skilled in the art will also be aware from the description that two or more connections 8 can be connected to each other via one or more additional connections. Lastly, the person skilled in the art will recognize that the pockets 7 can also be supplied with fluid via feed conduits (not shown) which lead from outside the delivery space 1 directly into the pockets 7, for example from the suction region or pressure region of the rotary pump.

LIST OF REFERENCE SIGNS

1 delivery space
2 housing
3 base
4 opening
5 inlet
6 outlet
7 pocket
8 connection
9 inner rotor
10 outer rotor
11 inner circumferential wall
12 outer circumferential wall
13 delivery cell
14 driving stay
15 sealing stay
16 sealing gap

The invention claimed is:

1. A rotary pump, comprising:

a housing featuring a delivery space which comprises an inlet for a fluid on a suction side of the rotary pump and an outlet for the fluid on a pressure side of the rotary pump;

an inner rotor which is arranged in the delivery space;

an outer rotor which is arranged in the delivery space and forms delivery cells with the inner rotor, wherein an outer circumferential wall of the outer rotor is mounted in a sliding manner on an inner circumferential wall of the delivery space, wherein the inner circumferential wall of the delivery space and/or the outer circumferential wall of the outer rotor comprises at least one pocket, wherein an axial extension of the at least one pocket is smaller than an axial length of the outer rotor and the at least one pocket has only one closed axial end, and wherein the at least one pocket is separated from the inlet and the outlet for the fluid.

2. The rotary pump according to claim 1, wherein the at least one pocket is open on an axial end facing a lid or a bottom which delimits the delivery space axially.

3. The rotary pump according to claim 1, wherein the housing comprises a cup-shaped housing part forming the inner circumferential wall and a bottom of the delivery space of the rotary pump, and wherein the at least one pocket is formed in the inner circumferential wall of the cup-shaped housing part.

4. The rotary pump according to claim 1, wherein the at least one pocket comprises a plurality of pockets.

5. The rotary pump according to claim 1, wherein the at least one pocket is formed in the inner circumferential wall of the delivery space.

6. The rotary pump according to claim 1, wherein the one closed axial end is a closed axial front end.

7. The rotary pump according to claim 1, wherein the at least one pocket is arranged in an area radially outward from the outlet and/or the inlet.

8. The rotary pump according to claim 1, comprising an electric drive.

* * * * *